US010172480B2

(12) United States Patent
Schaefer et al.

(10) Patent No.: US 10,172,480 B2
(45) Date of Patent: Jan. 8, 2019

(54) PRODUCT DISPLAY RACK ASSEMBLY AND METHOD

(71) Applicant: iSee Store Innovations, LLC, St. Louis, MO (US)

(72) Inventors: Mark Schaefer, Town and Country, MO (US); Sivateja Kasireddy, Maryland Heights, MO (US); Sesha Madireddi, Maryland Heights, MO (US)

(73) Assignee: iSee Store Innovations, L.L.C., St. Louis, MO (US)

( * ) Notice: Subject to any disclaimer, the term of this patent is extended or adjusted under 35 U.S.C. 154(b) by 0 days.

(21) Appl. No.: 15/612,738

(22) Filed: Jun. 2, 2017

(65) Prior Publication Data

US 2018/0344051 A1 Dec. 6, 2018

(51) Int. Cl.

| | |
|---|---|
| ***A47F 1/12*** | (2006.01) |
| ***A47F 7/28*** | (2006.01) |
| ***A47F 5/10*** | (2006.01) |

(52) U.S. Cl.

CPC ..... *A47F 1/12* (2013.01); *A47F 5/10* (2013.01); *A47F 7/28* (2013.01)

(58) Field of Classification Search

CPC ..... A47F 1/04; A47F 1/06; A47F 1/08; A47F 1/087; A47F 1/12; A47F 1/125; A47F 1/126; A47F 5/005; A47F 5/0068; A47F 5/10; A47F 7/17; A47F 7/28

See application file for complete search history.

(56) References Cited

U.S. PATENT DOCUMENTS

| | | | | |
|---|---|---|---|---|
| 2,915,162 A * | 12/1959 | Umstead | A47F 1/087 193/27 |
| 3,393,808 A * | 7/1968 | Chirchill | A47F 1/087 193/27 |
| 3,784,022 A * | 1/1974 | Beesley, Jr. | A47B 87/005 193/27 |
| 4,105,126 A * | 8/1978 | Deffner | A47F 1/12 211/59.2 |
| 4,598,828 A * | 7/1986 | Young | A47F 1/12 211/59.2 |
| 6,779,670 B2 * | 8/2004 | Primiano | A47F 1/12 211/175 |

(Continued)

*Primary Examiner* — Ko H Chan

(74) *Attorney, Agent, or Firm* — Joseph M. Butscher; The Small Patent Law Group, LLC

(57) ABSTRACT

A product display assembly includes a first side member, a second side member, and a cross member. The first side member includes at least one first rack assembly feature. The second side member includes at least one second rack assembly feature. The cross member is configured to be releasably securable to the first side member and the second side member. The cross member includes cross member rack assembly features configured to cooperate with the at least one first rack assembly feature and the at least one second rack assembly feature to releasably secure the cross member to the first side member and the second side member. The cross member is interposed between the first side member and the second side member and oriented perpendicular to the first side member and the second side member. The cross member comprises a support surface configured to support beverage containers.

19 Claims, 4 Drawing Sheets

(56) References Cited

U.S. PATENT DOCUMENTS

| | | | | |
|---|---|---|---|---|
| 6,874,646 | B2 * | 4/2005 | Jay | A47B 96/021 211/175 |
| 7,918,365 | B2 * | 4/2011 | White | A47F 1/087 221/123 |
| 9,107,516 | B2 * | 8/2015 | Pichel | A47F 1/04 |
| 2004/0011751 | A1 * | 1/2004 | Johnson | A47F 1/087 211/59.2 |
| 2011/0094980 | A1 * | 4/2011 | Cousin | A47F 5/005 211/59.2 |
| 2017/0119174 | A1 * | 5/2017 | Hardy | A47F 1/126 |

* cited by examiner

PRODUCT DISPLAY RACK ASSEMBLY AND METHOD

FIELD OF THE DISCLOSURE

Embodiments of the present disclosure generally relate to systems and methods for displaying products, such as beverage containers.

BACKGROUND OF THE DISCLOSURE

Various commercial enterprises offer beverages for sale in containers. For convenience of consumers, it is beneficial for the beverages to be organized in easily identifiable groups. Often, the amount of shelving or display space is limited. Conventionally, beverage containers may be displayed using racks. However, currently known racks may suffer from one or more of difficulty or inefficiency of shipping, limitations regarding stacking or other use of limited available space, and/or lack of flexibility of use with differently sized shelving environments.

SUMMARY OF THE DISCLOSURE

A need exists for a system and/or method of conveniently and reliably displaying products such as beverage containers.

Accordingly, certain embodiments of the present disclosure provide a product display assembly that is configured to display beverage containers. The assembly includes a first side member, a second side member, and a cross member. The first side member includes at least one first rack assembly feature. The second side member includes at least one second rack assembly feature. The cross member is configured to be releasably securable to the first side member and the second side member. The cross member includes cross member rack assembly features configured to cooperate with the at least one first rack assembly feature and the at least one second rack assembly feature to releasably secure the cross member to the first side member and the second side member. The cross member is interposed between the first side member and the second side member and oriented perpendicular to the first side member and the second side member. The cross member comprises a support surface configured to support the beverage containers.

Certain embodiments of the present disclosure provide a method of providing a product display assembly configured to display beverage containers. The method includes providing a first side member comprising at least one first rack assembly feature, providing a second side member comprising at least one second rack assembly feature, and providing a cross member comprising cross member rack assembly features. The method also includes joining the first side member to the cross member via the at least one first rack assembly feature and at least one of the cross member rack assembly features, and joining the second side member to the cross member via the at least one second rack assembly feature and at least one other of the cross member rack assembly features. The cross member is interposed between the first side member and the second side member and oriented perpendicular to the first side member and the second side member.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a beverage container rack (e.g., a gravity fed can dispensing rack). In various embodiments, the units are stackable (e.g., up to three levels of cans). Also, in various embodiments, a three-piece design is provided consisting of two sides and a base or cross member that are joined (e.g., by snapping together). Various embodiments provide for compact and inexpensive transportation or shipping of the assembly (e.g., in a dis-assembled state) and easy setup. Additionally, various embodiments allow retailers to adapt the display to suit available shelf height space. Further, with three separately accessible levels, for example, three different varieties of beverage may be placed in a relatively limited space (e.g., a space that previously would accommodate only two cants sitting vertically.

In various embodiments, a base or cross member includes pentagonal (or other polygonal) shaped holes or openings instead of slats, with the sides being rigid enough to provide for desired modularity and stackability. Various embodiments also provide additional attachment points to connect the sides to the base or cross member. Accordingly, various embodiments are sufficiently rigid to provide stacking of up to 3 levels of racks, and in some embodiments, additional product may be placed on top of an uppermost stack.

Various embodiments also provide a flat panel for improved labelling (e.g., with product logos). Additionally or alternatively, various embodiments provide a recessed or cutaway shape that allows a consumer to easily grasp and remove a beverage container (e.g., can).

Further still, various embodiments provide for scoring or break off lines for convenient removal of portions of a product display assembly to suit a given available space. Also, various embodiments provide a back retention member that may be integrally formed with another component (e.g., base or cross member) and removed from the other component (e.g., snapped off a back end of the cross member) prior to assembly.

Figure 1:
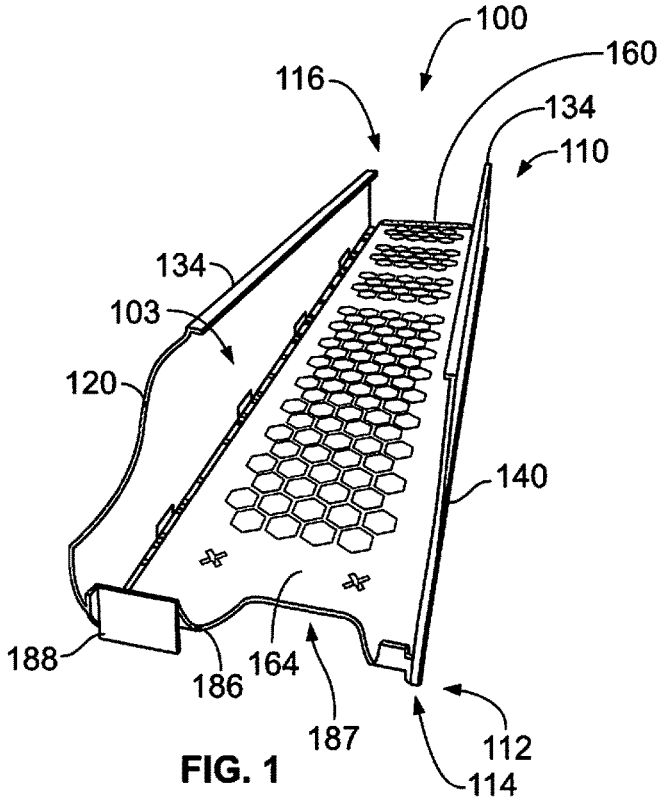
FIG. 1 illustrates a perspective front view of a product display assembly, according to an embodiment of the present disclosure.
Figure 2:
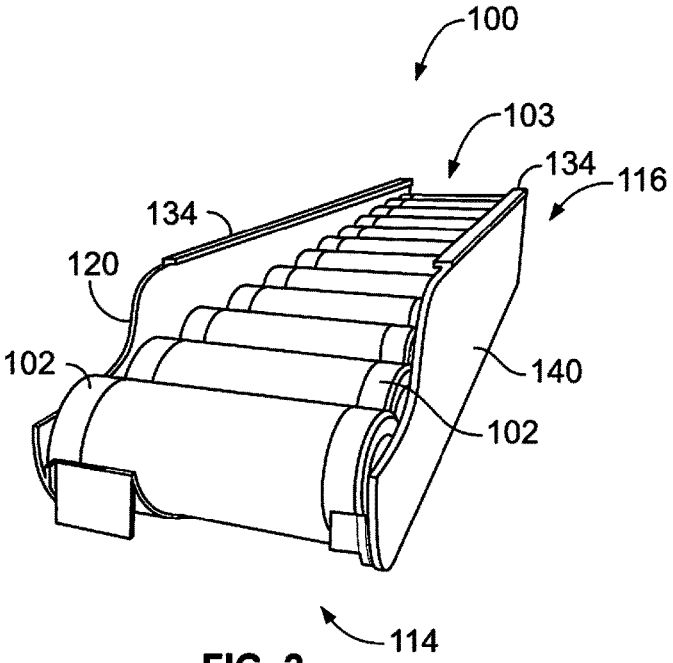
FIG. 2 illustrates a perspective front view of the product display assembly of FIG. 1 with beverage containers in place.
Figure 3:
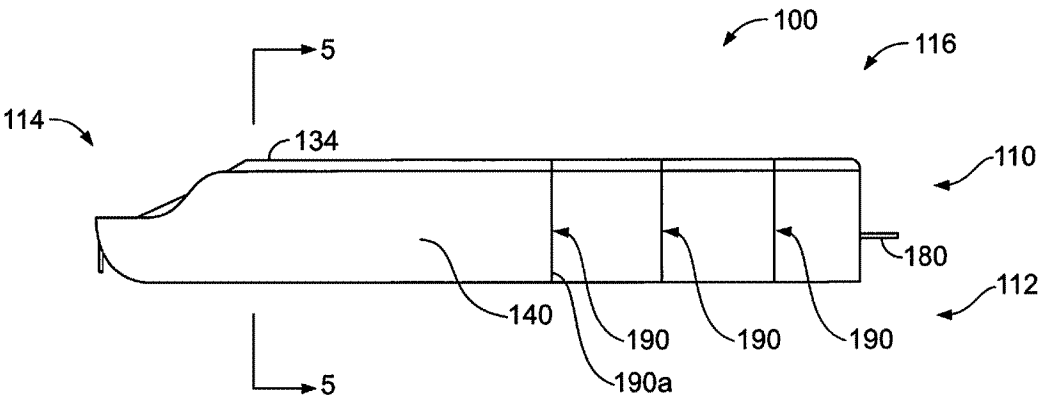
FIG. 3 illustrates a bottom view of the product display assembly of FIG. 1.
Figure 4:
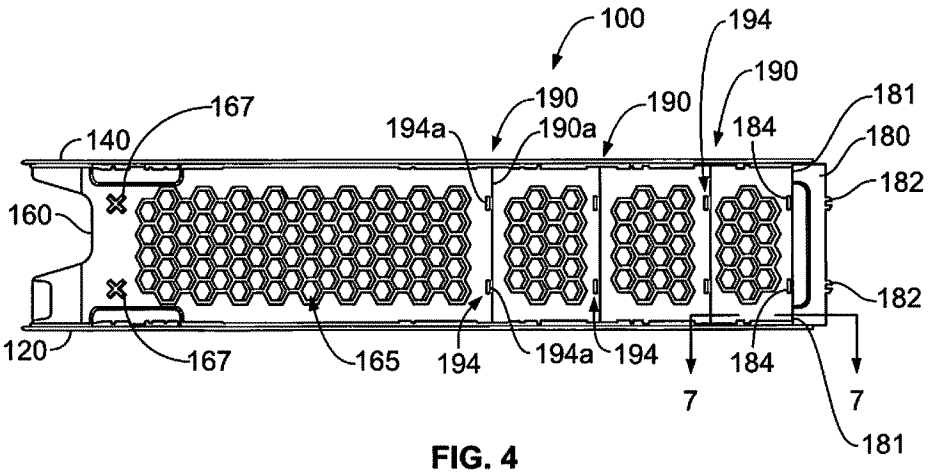
FIG. 4 illustrates a side view of the product display assembly of FIG. 1.

FIG. 1 illustrates a perspective front view of a product display assembly 100, according to an embodiment of the present disclosure. FIG. 2 illustrates a perspective front view of the product display 100 with beverage containers 102 disposed in an interior 103 of the product display 100. Also, FIG. 3 illustrates a side view of the product display assembly 100, and FIG. 4 illustrates a bottom view of the product display assembly 100. The product display assembly 100 generally is configured to display the beverage containers 102, for example in a retail environment. For example, the product display assembly 100 may be positioned on a shelf within a store. In various embodiments, the depicted product display assembly 100 may be used in conjunction with other similar product display assemblies (e.g., with two or more product display assemblies 100 arranged in a stacked arrangement). Also, it may be noted that the depicted embodiment is assembled using separate pieces, and may be assembled at or near a point of display, and/or may be assembled remotely at a different location. Accordingly, in various embodiments the product display assembly 100 may be provided as a kit, with various components provided in an un-assembled or partially assembled state. For example, the various aspects of product display assembly 100 may be manufactured (e.g., molded from a plastic), shipped to a second location (e.g., retail store or point of sale) in an unassembled condition, and assembled and used at the second location. As another example, the product display assembly 100 may be assembled at the second location, and then transported to a third location for use.

As seen in FIGS. 1-4, the product display assembly 100 includes a first side member 120, a second side member 140, and a cross member 160. Generally, the first side member 120, second side member 140, and cross member 160 are configured to be assembled or secured to each other to form an assembled product display assembly 100. In some embodiments, the first side member 120, second side member 140, and cross member 160 may be releasably securable to each other to allow for convenient assembly and/or disassembly. Shipping the product display assembly 100 in an un-assembled state may provide for more convenient, efficient shipping.

Figure 5:
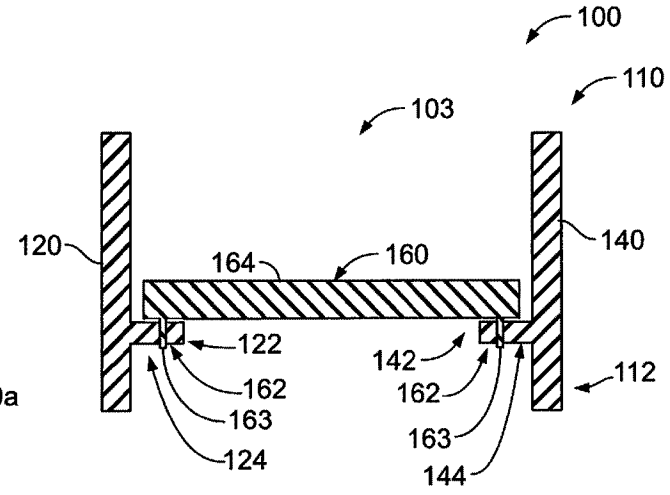
FIG. 5 a front sectional view of the product display assembly 100 taken along line 5-5 of FIG. 3.

Generally, the first side member 120 and second side member 140 define sides of the product display assembly 100 when in an assembled state as seen in FIGS. 1-4, and the cross member 160 provides a base on which the beverage containers 102 may be placed. As best seen in FIG. 5 (which provides a front sectional view of the product display assembly 100 taken along line 5-5 of FIG. 3), the cross member 160 is oriented perpendicular to the first side member 120 and the second side member 140, with the first side member 120 and the second side member 140 parallel to each other. The first side member 120, second side member 140, and cross member 160 in various embodiments are sized to accommodate a predetermined size of beverage container. As seen in FIGS. 1-5, the product display assembly 100 (and/or components thereof) define and/or include a top 110, a bottom 112, a front 114, and a rear 116. Generally, the depicted product display assembly 100 is configured for the beverage containers 102 to be removed (e.g., by a consumer) from the product display assembly 100 from the front 114.

As discussed herein, various components of the product display assembly 100 are configured to be securable (e.g., releasably securable) to other components of the product display 100 to place the product display assembly 100 in an assembled state. The assembly in various embodiments may take place at a point of manufacture, at a point of use, or a different location. In the illustrated embodiment, the first side member 120 includes at least one first rack assembly feature 122. Generally the first rack assembly feature 122 is configured to cooperate with at least one cooperating feature of the cross member 160 to join the first side member 120 to the cross member 160 and to align, position, and/or secure the first side member 120 in a desired position with respect to the cross member 160. The first side member 120 (as well as the second side member 140 and cross member 160) in various embodiments may be molded from a plastic.

Similarly, in the illustrated embodiment, the second side member 140 includes at least one second rack assembly feature 142. Generally the second rack assembly feature 142 is configured to cooperate with at least one cooperating feature of the cross member 160 to join the second side member 140 to the cross member 160 and to align, position, and/or secure the second side member 140 in a desired position with respect to the cross member 160.

The depicted cross member 160 is configured to be releasably securable to the first side member 120 and the second side member 140. In the illustrated embodiment, the cross member 160 includes cross member rack assembly features 162. The cross member rack assembly features 162 are configured to cooperate with at least one first rack assembly feature 122 and at least one second rack assembly feature 142 to releasably secure the cross member 160 to the first side member 120 and also to the second side member 140. In the assembled state, the cross member 160 of the illustrated embodiment is interposed between the first side member 120 and the second side member 140 and oriented perpendicular (e.g., within a range permitted by manufacturing tolerances and/or clearances between securement features joining the various components) to the first vertical member 120 and the second vertical member 140. Also the cross member 160 includes a support surface 164 configured to support the beverage containers 102.

As discussed herein, the first side member 120, second side member 140, and cross member 160 include various features configured to secure the first side member 120 to the cross member 160 and to secure the second side member 120 to the cross member 160. For example, tabs and slots may be utilized to secure the various components together. For instance, as best seen in FIG. 5, the cross member rack assembly features 162 include tabs 163. As also seen in FIG. 5, the first rack assembly feature 122 includes a slot 124, and the second rack assembly feature 142 includes a slot 144. The slots 124, 144 are configured to accept a corresponding tab 164. In various embodiments, the tabs 163 may be configured to be slid in (to assemble) and out (to disassemble) of the slots 124, 144, thereby providing releaseable securability between the components. Accordingly, in such embodiments, the side members may be non-destructively joined and subsequently separated from the cross member 160. It may be noted that in alternate embodiments, for example, the mounting of the slots and tabs may be reversed (e.g., the cross member 160 may include slots that accept tabs of the first side member 120 and the second side member 140). It may further be noted that, while in some embodiments only a single rack assembly feature may be present on each side member, in other embodiments multiple rack assembly features may be distributed along the length of the product display assembly 100 for added security, redundancy, and/or improved alignment.

As seen in FIGS. 1-3 and 5, the first side member 120 and the second side member 140 define a top 110 and a bottom 112. As best seen in FIG. 5, the cross member 160 is interposed between the top 110 and the bottom 112. As seen in FIG. 5, the cross member 160 is interposed laterally or horizontally between the first side member 120 and the second side member 140, and interposed between the top 110 and the bottom 112 vertically. As such, the first side member 120 and the second side member 140 both extend above the cross member 160 and below the cross member 160.

Figure 6:
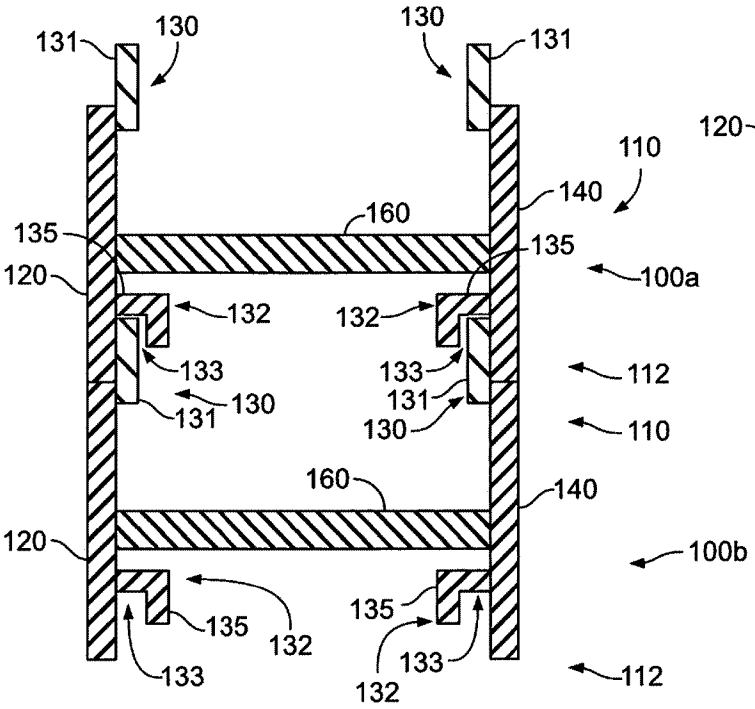
FIG. 6 illustrates a sectional view of stacked product display assemblies, according to an embodiment of the present disclosure.

In various embodiments, such an arrangement of the first side member 120, second side member 140, and cross member 160 (e.g., first and second side members 120, 140 extending above and below the cross member 160) provides for improved performance and/or convenience when stacking product display assemblies 100. For example, various embodiments provide improved resistance to twisting and/or improved stability and alignment for stacking. FIG. 6 illustrates a sectional view of portions of two product display assemblies 100, with product display assembly 100*a* stacked on top of product display assembly 100*b* in a stacked arrangement. Product display assemblies 100*a* and 100*b* may be generally similar in various respects with product display assembly 100.

As seen in FIG. 6, the first side member 120 and the second side member 140 each include first stacking cooperating features 130 disposed proximate the top 110, and also include second stacking cooperating features 132 disposed proximate the bottom 112. The first stacking cooperating features 130 and the second stacking cooperating features 132 are configured to at least one of align or secure the product display assembly (e.g., product display assembly 100*a*) to at least one additional product display assembly (e.g., product display assembly 100*b*). For example, the first stacking cooperating features 130 may accept and/or be accepted by the second stacking cooperating features 132 to align and stabilize the product display assemblies 100*a*, 100*b* in a stacked arrangement. In the illustrated embodiment, the stacking cooperating features 130, 132 of the second side members 140 are generally similar to the stacking cooperating features 130, 132 of the first side member 120, but they may be different in alternate embodiments. Generally, the stacking cooperating features 130, 132 of the second side member 140 are configured to cooperate with each other, and the stacking features 130, 132 of the first side member 120 are configured to cooperate with each other.

For example, in the embodiment depicted in FIG. 6, the first stacking cooperating features 130 include stacking tabs 131 disposed proximate the top 110. Also, the second stacking cooperating features 132 include stacking slots 133 configured to accept the stacking tabs 131. Accordingly, as seen in FIG. 6, stacking slots 133 of product display assembly 100*a* accept stacking tabs 131 of product display assembly 100*b* to align and/or secure the product display assemblies 100*a*, 100*b* in a stacked arrangement with product display assembly 100*a* on top of product display assembly 100*b*. In the illustrated embodiment, the stacking slots 133 are defined within an interior of an L-shaped member 135. Further, it may be noted that stacking tabs 131 disposed proximate the top of product display assembly 100*a* may be accepted by stacking slots of an additional product display assembly (not shown in FIG. 6) stacked on top of product display assembly 100*a*. Additionally or alternatively, stacking slots 133 disposed proximate the bottom product display assembly 100*b* may accept stacking tabs of an addition product display assembly (not shown in FIG. 6) stacked below product display assembly 100*b*.

Further still, additionally or alternatively, the side members may include one or more additional structures or features configured for improved convenience and/or stability when stacking. For example, as best seen in FIG. 1, the first side member 120 and the second side member 140 each include a ledge 134. The ledge 134 is disposed proximate the top 110, and is configured to align and/or secure the product display assembly with at least one additional product display assembly (e.g., to align and/or secure product display assembly 100*a* with product display assembly 100*b*). It may be noted that in some embodiments, the ledge 134 may be configured as a first stacking cooperating feature 130. For example, the ledge 134 may extend for a length along the product display assembly 100, and be accepted by one or more second stacking cooperating features 132 (e.g., the ledge 134 may be inserted into the opening defined by one or more L-shaped members 135 to be accepted by one or more corresponding stacking slots 133). Stacking product display assemblies in various embodiments allows for convenient, efficient placement of product display assemblies within an available shelving space and/or allows for display of different products in different levels of a stacked array of product display assemblies.

In various embodiments, the product display assembly 100 includes one or more features or structures configured to help contain the beverage containers 102 within the interior 103 of the product display assembly 100. For example, the first side member 120 and the second side member 140 help prevent the beverage containers 102 from leaving the interior 103 along lateral directions. As another example, in some embodiments, a back retention member is employed to help prevent the beverage containers 102 from leaving the interior 103 via the rear 116.

Figure 7:
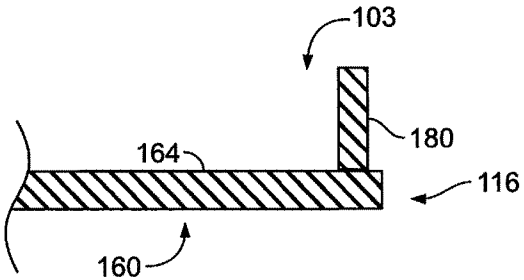
FIG. 7 illustrates a sectional view taken along line 7-7 of FIG. 4.

FIG. 7 illustrates a section taken along lines 7-7 of FIG. 4, with a back retention member 180 secured in place to help prevent the beverage containers 102 from leaving the interior 103 via the rear 116. It may be noted that in FIG. 4, the back retention member 180 is depicted in a shipping or pre-assembly position in which the back retention member 180 extends straight from the support surface 164 (or along the same plane as the support surface). As seen in FIG. 4, the back retention member 180 includes back retention tabs 182, and the cross member 160 includes back retention slots 170 that accept the back retention tabs 182. With the back retention tabs 182 inserted into the back retention slots 170, the back retention member 180 is placed in a retaining position as depicted in FIG. 7.

As discussed above, the back retention member 180 may be initially provided in various embodiments in a shipping or pre-assembly position in which the back retention member 180 extends straight from the support surface (e.g., as shown in FIGS. 3 and 4). In various embodiments, the back retention member 180 is snappably removable from the cross member 160 (e.g. from a portion of the cross member 160 proximate the rear 116 or a rear of the cross member 160). For example, the back retention member 180 may be formed (e.g., molded) integrally with the cross member 160. For improved accuracy and convenience of removal of the back retention member 180 from the cross member 160, a score or relief line 181 may be provided, along which the back retention member 180 may be bent with respect to the cross member 160 until the back retention member 180 snaps off of the cross member 160. Alternatively, for example, the back retention member 180 may be cut or otherwise removed from the cross member 160.

In various embodiments, the product display assembly 100 may be configured for use with shelves of different lengths. For example, as seen in FIGS. 3 and 4, the depicted first side member 120, second side member 140, and cross member 160 include score lines 190. The score lines 190 are located and configured for removing corresponding portions of the first side member 120, second side member 140, and cross member 160. The score lines 190 may be located in predetermined positions corresponding to known shelving lengths. For example, when use with a relatively long shelf, no portions of the product display assembly 100 may be removed to allow for a maximum number of beverage containers 102 to be placed in the product display assembly 100. However, for a shorter shelf length corresponding to score lines 190*a*, the portions of the first side member 120, second side member 140, and cross member 160 that are disposed rearward of the score line 190*a* may be removed before the first side member 120, second side member 140, and cross member 160 are assembled. For example, the portions may be removed by bending and/or cutting along the score line 190*a*. It may be noted that in various embodiments the cross member 160 includes back retention slot groups 194 (which each include back retention slots 170). Each back retention slot group 194 in the illustrated embodiments is positioned proximate (and forward of) a corresponding score line 190, and is configured for placement of the back retention member 180 after removal of corresponding portions of the product display assembly 100 along the corresponding score line. For example, when portions rearward of score line 190*a* are removed, back retention slot group 194*a* may be used for mounting the back retention member 180.

As best seen in FIG. 1, for the depicted embodiment, the cross member 160 includes a curved surface 186 disposed proximate the front 114. The curved surface 186 is configured to correspond to a shape of the beverage containers 102. For example, the curved surface 186 may have a radius within a predetermined range of a can radius for cans to be placed in the product display assembly 100. In the illustrated embodiment, the curved surface 186 includes a cut away 187. The cut away 187 is configured to provide access to the interior 103 of the product display assembly 100. For example, the cut away 187 may be sized and positioned to allow a consumer to place fingers around a beverage container 102 to grasp and remove the beverage container 102. As also seen in FIG. 1, the product display assembly 100 includes a flat portion 188 disposed proximate the front 114 and proximate the curved surface 186. The flat portion 188 may be utilized, for example, for product identification, pricing information, and/or advertising. The flat portion 188 in various embodiments may be integrally formed (e.g., molded) with the cross member 160.

It may be noted that, in various embodiments, the support surface 164 is sloped downward from the rear 116 to the front 114 (e.g., the support surface 164 is relatively closer to the bottom 112 proximate the front 114 and relatively closer to the top 110 proximate the rear 116). The slope in various embodiments helps to urge the beverage containers 102 toward the front 114 for more convenient removal from the front 114. The slope may be selected to function effectively in conjunction with both straight and sloped shelves. For example, a slope of 5 degrees may effectively urge beverage container 102 toward the front 114 when the bottom 112 of the product display system 100 is placed on either a flat shelf (e.g., slope of 0 degrees) or a sloped shelf (e.g., slope of 10-15 degrees).

Various embodiments also provide for convenient securement to a shelf or other structure. For example, as best seen in FIG. 4, the depicted support surface 164 has securement openings 167 that extend through the support surface 164. The securement openings 167 are configured to accept a fastening member (e.g., a cable tie, wire, clip; not shown in FIG. 4) that is configured to secure the product display assembly 100 to a shelf. In the illustrated embodiment, the securement openings are cross-shaped or shaped like an "x" or "+" sign. Further, additionally or alternatively, the support surface 164 may have openings or other features configured to lighten the cross member 160. In the depicted embodiment, the support surface 164 includes openings 165 that extend through the support surface. The openings 165 of the illustrated embodiment are hexagonal openings arranged in a honeycomb pattern. Such a pattern provides an example of a pattern that allows for a lighter cross member 160 while still providing adequate structural rigidity. It may be noted that other shapes and/or arrangements of openings 165 may be utilized in alternate embodiments.

Figure 8:
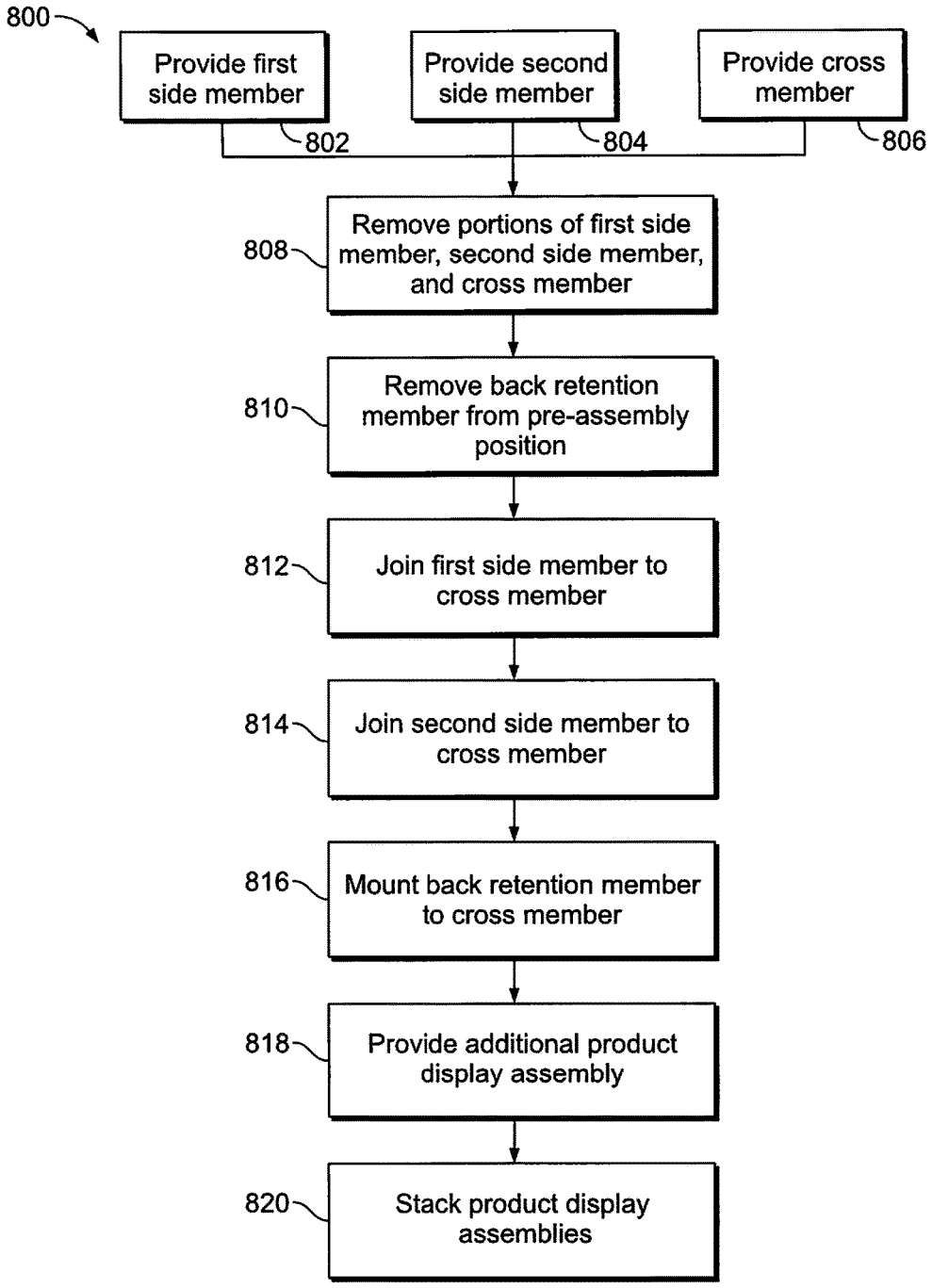
FIG. 8 illustrates a flow chart of a method of displaying products within an adjustable product display system, according to an embodiment of the present disclosure.

FIG. 8 illustrates a flow chart of providing a product display assembly (e.g., product display assembly 100), according to an embodiment of the present disclosure. It may be noted that various steps may be omitted, combined with other steps, performed more than once, and/or performed in different orders in various embodiments.

The method begins at 802, at which a first side member (e.g., first side member 120) is provided. The first side member includes at least one first rack assembly feature as discussed herein. At 804, a second side member (e.g., second side member 140) is provided. The second side member includes at least one second rack assembly feature as discussed herein. Also, at 806, a cross member (e.g., cross member 160) is provided. The cross member includes cross member rack assembly features which are configured to cooperate with the first and second rack assembly features to join the first side member, second side member, and cross member together. It may be noted that, in various embodiments, the first side member, second side member, and cross member may be provided in a dis-assembled or partially assembled condition as part of a kit.

At 808 in the depicted embodiment, portions of the first side member, second side member, and cross member are removed. In various embodiments, the portions may be removed (e.g., removed by bending and snapping a portion off, removed by cutting, removed by sawing) along predefined score lines provided at predetermined locations (e.g., corresponding to available shelving lengths) on the first side member, second side member, and cross member. The portions may be removed before joining the various components together. In other embodiments, for example embodiments where an available shelf length exceeds the maximum length of the product display assembly, this step may be omitted and portions need not necessarily be removed.

At 810 in the depicted embodiment, a back retention member (e.g., back retention member 180) is removed from a pre-assembly position. For example, in some embodiments, the back retention member, in the pre-assembly position, extends straight from the cross member (e.g., along a plane defined by a base or support surface of the cross member). In some embodiments, the back retention member may be initially formed integrally with the cross member (e.g., as part of a molding process), and then snapped off, cut off, or otherwise removed from the cross member. It may be noted that in other embodiments, this step may be omitted. For example, in some embodiments, a back retention member may not be utilized. In other embodiments, as another example, a back retention member (or members) may be formed in a retaining position integrally with one or more of the first side member, second side member, or cross member (e.g., extending perpendicularly from or at an oblique angle from the first side member, second side member, or cross member).

At 812, the first side member is joined to the cross member. For example, in some embodiments, at least one first rack assembly feature and at least one cross member rack assembly feature are used to join the first side member to the cross member. For instance, one or more slots associated with one of the first side member or the cross member may accept one or more tabs associated with the other of the first side member or the cross member.

At 814, the second side member is joined to the cross member. For example, in some embodiments, at least one second rack assembly feature and at least one cross member rack assembly feature are used to join the second side member to the cross member. For instance, one or more slots associated with one of the second side member or the cross member may accept one or more tabs associated with the other of the second side member or the cross member.

At 816, the back retention member (e.g., back retention member 180) is mounted to the cross member. In various embodiments, back retention tabs of the back retention member are inserted into back retention slots of the cross member.

In some embodiments, more than one product display assembly may be utilized. For example, in the illustrated embodiment, at 818, an additional product display assembly is provided (e.g., using steps 802-816 above). At 820, the additional product display assembly is stacked with a previously obtained or provided product display assembly. In various embodiments, the product display assemblies are stacked using stacking cooperating features as discussed herein. For example, the product display assemblies may be stacked using first stacking cooperating features disposed proximate a top of a product display assembly and second stacking cooperating features disposed proximate a bottom of a different product display assembly. The first and second stacking cooperating features in various embodiments are configured to cooperate with each other to align and/or secure product display assemblies together in a stacked arrangement. For example, in various embodiments, slots, tabs, and/or ledges may be utilized.

Referring to FIGS. 1-8, embodiments of the present disclosure provide a product display assembly that allows for display one or more products. Product display assemblies as discussed herein may be conveniently shipped in an un-assembled state and assembled at a point of use. Also, product display assemblies as discussed herein may provide for convenient and reliable stacking with other product display assemblies.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A product display assembly configured to display beverage containers, the assembly comprising:

a first side member comprising at least one first rack assembly feature;

a second side member comprising at least one second rack assembly feature;

a cross member configured to be releasably securable to the first side member and the second side member, the cross member comprising cross member rack assembly features configured to cooperate with the at least one first rack assembly feature and the at least one second rack assembly feature to releasably secure the cross member to the first side member and the second side member, wherein the cross member is interposed between the first side member and the second side member and oriented perpendicular to the first side member and the second side member, wherein the cross member comprises a support surface configured to support the beverage containers; and a back retention member integrally formed with the cross member and extending straight from the support surface when the back retention member is in a pre-assembly position, the back retention member configured to be removable from the cross member and re-positioned to a retaining position at which the back retention member is perpendicular to the cross member, the back retention member including back retention tabs configured to be accepted by back retention slots of the cross member when the back retention member is in the retaining position.

2. The product display assembly of claim 1, wherein the cross member rack assembly features comprise tabs, wherein the first and second rack assembly features comprise slots, and wherein the slots are configured to accept the tabs.

3. The product display assembly of claim 1, wherein the first side member and the second side member define a top and a bottom, wherein the cross member is interposed between the top and the bottom.

4. The product display assembly of claim 3, wherein the first side member and the second side member each comprise first stacking cooperating features disposed proximate the top and second stacking cooperating features disposed proximate the bottom, the first and second stacking cooperating features configured to at least one of align or secure the product display assembly with at least one additional product display assembly.

5. The product display assembly of claim 4, wherein the first stacking cooperating features comprise stacking tabs and the second stacking features comprise stacking slots configured to accept the stacking tabs.

6. The product display assembly of claim 3, wherein the first side member and the second side member each comprise a ledge disposed proximate the top, the ledge configured to align or secure the product display assembly with at least one additional product display assembly.

7. The product display assembly of claim 1, wherein the back retention member is snappably removable from a rear of the cross member.

8. The product display assembly of claim 1, wherein the first side member, second side member, and cross member comprise score lines, the score lines located and configured for removing corresponding portions of the first side member, second side member, and cross member.

9. The product display assembly of claim 8, wherein the cross member comprises back retention slot groups disposed proximate corresponding score lines of the cross member.

10. The product display assembly of claim 1, wherein the cross member comprises a curved surface proximate a front of the cross member, the curved surface configured to correspond to a shape of the beverage containers, the curved surface comprising a cut away configured to provide access to an interior of the product display assembly.

11. The product display assembly of claim 10, further comprising a flat portion disposed proximate the front of the cross member and proximate the curved surface.

12. The product display assembly of claim 1, wherein the support surface has openings extending therethrough.

13. The product display assembly of claim 1, wherein the support surface is sloped downward from the rear to the front relative to a bottom defined by the first and second side members.

14. The product display assembly of claim 1, wherein the support surface has cross-shaped securement openings extending therethrough.

15. A method of providing a product display assembly configured to display beverage containers, the method comprising:

providing a first side member comprising at least one first rack assembly feature;

providing a second side member comprising at least one second rack assembly feature;

providing a cross member comprising cross member rack assembly features, the cross member comprising an integrally formed back retention member, the back retention member extending straight from a support surface of the cross member in a pre-assembly position;

joining the first side member to the cross member via the at least one first rack assembly feature and at least one of the cross member rack assembly features;

joining the second side member to the cross member via the at least one second rack assembly feature and at least one other of the cross member rack assembly features, wherein the cross member is interposed between the first side member and the second side member and oriented perpendicular to the first side member and the second side member;

removing the back retention member from the cross member; and re-positioning the back retention member to a retaining position at which the back retention member is perpendicular to the cross member.

16. The method of claim 15, further comprising mounting the back retention member to the cross member by inserting back retention tabs of the back retention member into back retention slots of the cross member.

17. The method of claim 16, further comprising snappably removing the back retention member from the pre-assembly position in which the back retention member extends straight from the cross member.

18. The method of claim 15, further comprising removing portions of the first side member, second side member, and cross member along predefined score lines before joining the first side member to the cross member and the second side member to the cross member.

19. The method of claim 15, further comprising:

providing an additional product display assembly; and stacking the additional product display assembly and the product display assembly via first stacking cooperating features disposed proximate a top of the additional product display assembly and second stacking cooperating features disposed proximate a bottom of the product display assembly.

* * * * *